US007354273B2

(12) United States Patent
Donelan

(10) Patent No.: US 7,354,273 B2
(45) **Date of Patent: *Apr. 8, 2008**

(54) DRY ERASABLE BOARD

(76) Inventor: James P. Donelan, 4720 Wallbank Ave., Downers Grove, IL (US) 60515

( * ) Notice: Subject to any disclaimer, the term of this patent is extended or adjusted under 35 U.S.C. 154(b) by 251 days.

This patent is subject to a terminal disclaimer.

(21) Appl. No.: 11/116,019

(22) Filed: Apr. 27, 2005

(65) Prior Publication Data

US 2005/0186391 A1 Aug. 25, 2005

Related U.S. Application Data

(63) Continuation of application No. 10/003,561, filed on Oct. 24, 2001, now Pat. No. 6,893,266.

(51) Int. Cl.
*B43L 1/00* (2006.01)

(52) U.S. Cl. ..... 434/408

(58) Field of Classification Search ..... 434/408, 434/410, 411, 413, 414, 416, 419, 425, 326, 434/363, 364

See application file for complete search history.

(56) References Cited

U.S. PATENT DOCUMENTS 1,757,287 A 5/1930 Bildstein
1,774,215 A * 8/1930 Weinthrop ..... 229/67.1
2,879,608 A 3/1959 Watkins
3,149,426 A 9/1964 Kaeyer
3,405,460 A 10/1968 Michaelson
3,512,273 A 5/1970 Baker, Jr. et al.
3,579,871 A 5/1971 Eddington
4,583,764 A * 4/1986 Steffen ..... 281/31
5,010,671 A 4/1991 Stonehouse
5,174,606 A * 12/1992 Hure ..... 281/45
5,324,202 A 6/1994 Meyers et al.
5,367,350 A * 11/1994 Winfrey ..... 353/120
5,472,239 A 12/1995 Trujillo
5,527,568 A 6/1996 Boone et al.
5,599,189 A 2/1997 Kees
5,655,323 A * 8/1997 Lassoff ..... 40/611.1
5,833,790 A * 11/1998 Hare ..... 156/240
5,900,094 A 5/1999 Santini et al.
5,904,374 A * 5/1999 Lee ..... 281/29
5,918,394 A 7/1999 Babcock
5,964,544 A * 10/1999 Ko ..... 402/36
6,067,266 A * 5/2000 Donelan ..... 365/218
D427,632 S * 7/2000 McNeil ..... D19/33
6,453,589 B1 * 9/2002 Schwartz ..... 40/359
6,620,500 B2 * 9/2003 Sweet et al. ..... 428/355 RA

* cited by examiner

*Primary Examiner*—Kurt Fernstrom
(74) *Attorney, Agent, or Firm*—Bell, Boyd & Lloyd LLP

(57) ABSTRACT

A dry erase board is provided having a body having dry erase characteristics. The body has at least one bent end. A sheet having indicia can be secured between the body and the bent end. A user can then write on the body in correlation to the indicia on the sheet.

14 Claims, 4 Drawing Sheets

FIG. 6
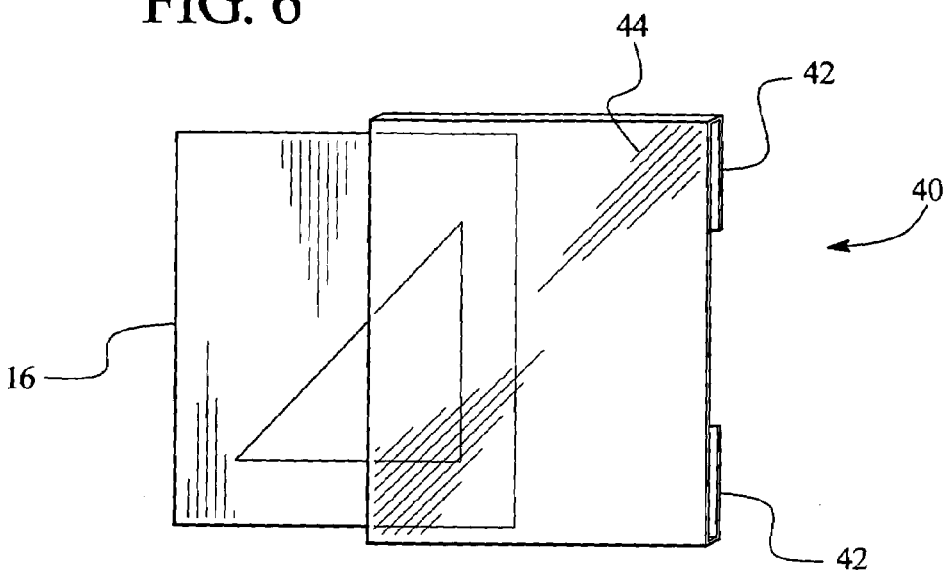
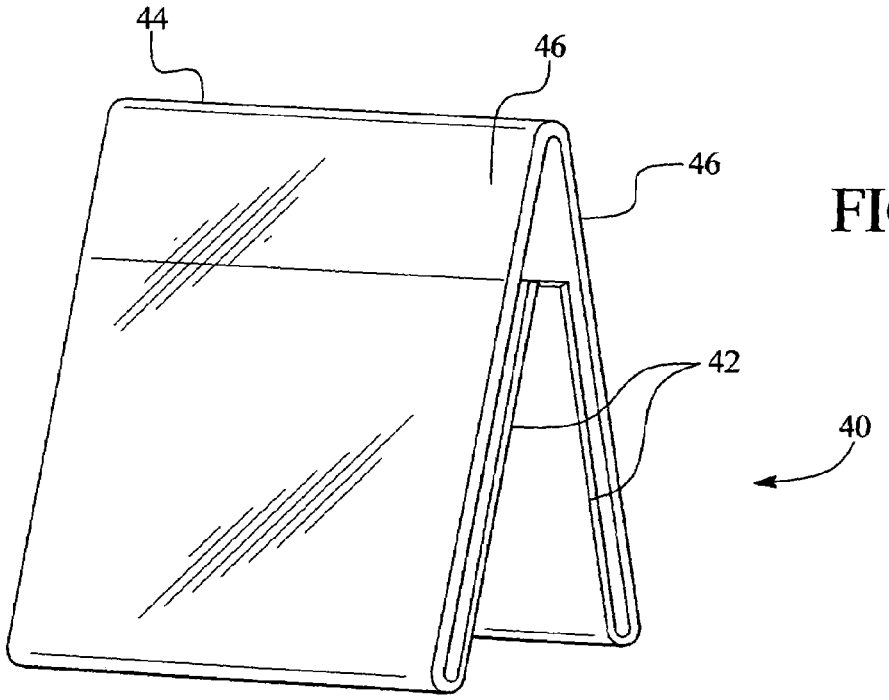
FIG. 7

DRY ERASABLE BOARD

CROSS REFERENCE TO RELATED APPLICATIONS

This patent application is a continuation of U.S. application Ser. No. 10/003,561, filed on Oct. 24, 2001, now U.S. Pat. No. 6,893,266 the disclosure of which is herein incorporated by reference.

BACKGROUND OF THE INVENTION

The present invention relates generally to substrates that allow one to mark thereon. More specifically, the present invention relates to "dry erase" boards.

It is known to provide what is referred to as a dry erase board. A typical dry erase board includes a board or substrate that is coated with an enamel, film, ultraviolet cured liquid, liquid varnish, or porcelain finish. Specially designed markers are used to write on the substrate. While the ink of the marker dries on the substrate, the ink does not bond to the substrate surface and the writing can be easily removed with a soft eraser, cloth, finger, etc.

However, a disadvantage of dry erase boards is the inability to easily either apply graphics or indicia to the substrate or the inability to easily change any graphics or indicia that have been previously applied to the substrate. For example, some dry erase boards are provided with horizontal lines for writing purposes. The lines are not removable and cannot be altered. Other boards may have an indicia or a design permanently adhered to the board with paint or permanent marking pens. Again, once the indicia is applied, it is difficult or time consuming to remove.

Other dry erase boards have been provided having a clear body and a substrate, allowing the placing of sheets between the clear film and the substrate. However, these dry erase boards are expensive to manufacture because the substrate must be attached to the clear film. Further, these dry erase boards are difficult to package because of the rigidity of the substrate. In addition, alternating sheets within these dry erase boards can be a time-consuming task. Yet another disadvantage of these boards is that a user may only print on one side of the dry erase boards. This is a problem when using two-sided sheets such as flash cards, for example.

A need, therefore, exists for an improved dry erase board which eliminates the need for a substrate and enables more convenient use of multiple alternate indicia.

SUMMARY OF THE INVENTION

The present invention provides improved dry erase boards which do not require a separate rigid substrate. The dry erase board has a semi-rigid body including a bent end. The bent end supports a sheet that is placed between the bent end and the body. This allows sheets, having varying indicia, to be removably secured to, or positioned within, the dry erase board. A user can then write on a front side of the body in correlation to the indicia displayed on the sheet.

To this end, in an embodiment of the present invention, a dry erase board is provided. The dry erase board includes a body having dry erase characteristics. The body has at least one bent end. The bent end is capable of removably securing a sheet of paper to the body.

In an embodiment, the dry erase board is in a flat state when shipped to a user.

In an embodiment, the bent end has a first bent section and a second bent section. The first bent section contacts a surface of the sheet and the second bent section contacts an edge of the sheet.

In an embodiment, the body is semi-rigid.

In an embodiment, the entire body is transparent.

In an embodiment, the dry erase board includes a second bent end.

In an embodiment, a first bent end contacts a first edge of the sheet and the second bent end contacts a second edge of the sheet.

In an embodiment, a plurality of bent ends is provided which extend along a periphery of the body.

In another embodiment of the present invention, a method is provided for manufacturing a dry erase board. The method comprises the steps of providing a body having dry erase characteristics; and bending a side of the body to create an area for receiving a sheet.

In an embodiment, the method has the additional step of bending a second side of the body to create an area for receiving the sheet.

In an embodiment, the method has the additional step of applying an adhesive to the side.

In another embodiment of the present invention, a dry erase board is provided. The dry erase board has a body having dry erase characteristics. In addition, the dry erase board has a pocket for receiving a sheet.

In an embodiment, the pocket is integrally formed.

In an embodiment, the pocket is attached by an adhesive layer.

In an embodiment, the pocket has dry erase characteristics.

In another embodiment of the present invention, a method is provided for using a dry erase board. The method comprises the steps of providing a dry erase board including a front face having dry erase characteristics and an open back surface for removably receiving a sheet of material; and removably securing the sheet of material to the dry erase board.

In an embodiment, the sheet is removably secured by inserting the sheet in a lip defined by a bent end of the dry erase board.

It is, therefore an advantage of the present invention to provide a dry erase board which eliminates the need for a separate rigid substrate.

Another advantage of the present invention is to provide a dry erase board which allows the use of multiple indicia.

Another advantage of the present invention is to provide a dry erase board which is easy to manufacture.

Another advantage of the present invention is to provide a dry erase board that is inexpensive to manufacture.

Additional features and advantages of the present invention are described in, and will be apparent in the detailed description of the presently preferred embodiments and from the drawings.

BRIEF DESCRIPTION OF THE FIGURES

FIG. 6 illustrates a perspective view of a dry erase board in an embodiment of the present invention.

FIG. 7 illustrates a perspective view of the dry erase board of FIG. 6 in a folded position.

DETAILED DESCRIPTION OF THE INVENTION

Improved dry erase boards are provided as well as methods of manufacturing the same.

Figure 1:
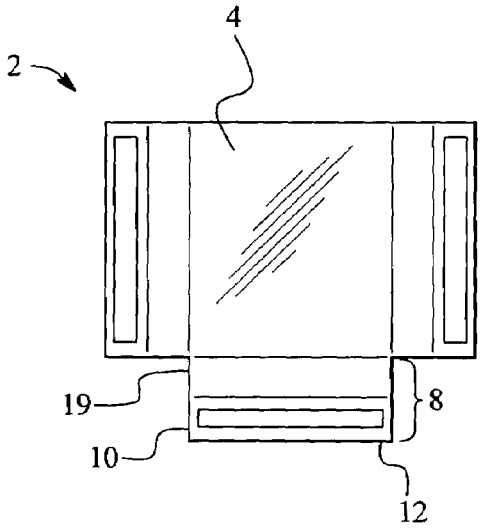
FIG. 1 illustrates a perspective view of a dry erase board in an embodiment of the present invention.

Referring to the figures, FIG. 1 illustrates an embodiment of the dry erase board 2 of the present invention. The dry erase board 2 has a body 4. Preferably, the body 4 is semi-rigid and is transparent. However, if desired, only a portion of the body 4 can be transparent. The body 4 may consist of any material that has dry erase characteristics. For example, the body 4 may comprise a polypropylene film, a polyethylene film or the like. The body 4 may have any shape. In an embodiment, the body 4 is rectangular in shape and is sized to cover a standard sheet of paper.

The dry erase board is designed so that a user can write on a front side 5 or back side 7 of the body 4 with a dry erase marker. Use of the dry erase marker allows the writing to be conveniently removed.

The body 4 includes at least one bent end 8. The bent ends 8 are preferably rectangular and have a plurality of sections. In an embodiment, the bent ends 8 have two bent sections. A first bent section 10 is located at the outermost portion 12 of the bent end 8. The first bent section 10 may have an adhesive layer. A second bent section 14 is located adjacent to the first bent section 10.

Figure 2:
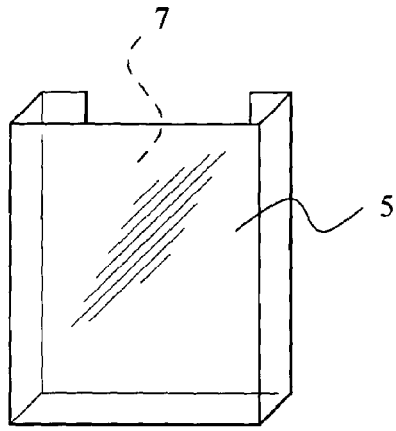
FIG. 2 illustrates a perspective view of the dry erase board of FIG. 1 in an assembled state in an embodiment of the present invention.

FIG. 1 shows the dry erase board 2 in a flat state. The dry erase board 2 can be shipped to a user in this state. The dry erase board 2 may have perforations enabling a user to fold the first bent section 10 and second bent section 14. In alternate embodiments, the first bent section 10 and second bent section 14 are heated or chemically treated to enable the first bent section 10 and second bent section 14 to be folded without reverting to the flat state. Other methods of treating the body 4 to enable folding are also contemplated. The user can fold the first bent section 10 and second bent section 14, as seen in FIG. 2, whereby the first bent section 10 is positioned to contact a surface 17 of a sheet 16. The second bent section 14 is then positioned to contact an edge 19 of the sheet 16.

The sheet 16 may have indicia, whether written or printed. The dry erase board 2 is designed in an embodiment so that the indicia can be seen through the body 4. A user can then write on the front side 5 of the body 4 in correlation to the indicia. If, for example, the user intends to provide indicia in addition to the indicia displayed on the sheet 16, the user can write on the back side 7 of the body 4. The new indicia can be seen on the front side 5 of the body 4. The user can then write on the front side 5 of the body in correlation to both the indicia on the sheet 16 and the new indicia.

Figure 3:
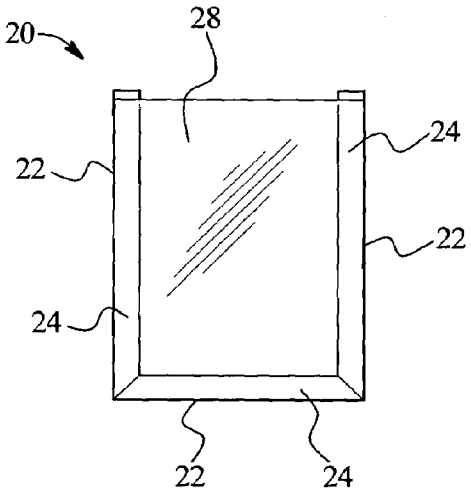
FIG. 3 illustrates a perspective view of a dry erase board in an embodiment of the present invention.
Figure 4:
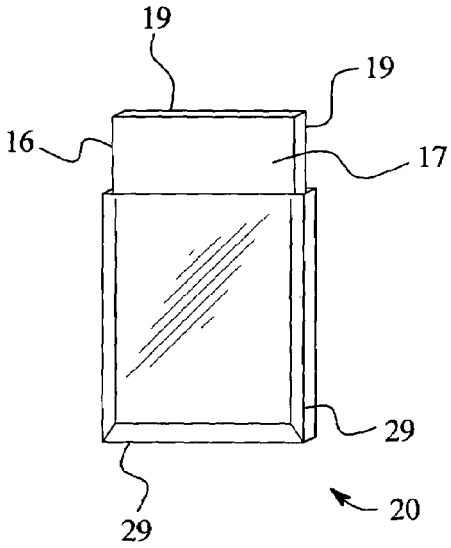
FIG. 4 illustrates a perspective view of the dry erase board of FIG. 3 in an embodiment of the present invention.

In another embodiment of the dry erase board 20, illustrated in FIG. 3, the bent ends 22 have only a first bent section 24. This embodiment may also be shipped in a flat state with the body 28 being pre-treated to enable the user to fold the first bent section 24. The first bent section 24 may have an adhesive layer. As a result, a sheet 16 may be supported by each of the bent ends 22 and the body 28, as illustrated in FIG. 4. The sheet 16 may slide along the bent ends 22 on opposite sides of the dry erase board 20, while positioned between the bent ends 22 and the body 28.

The first bent section 24 contacts the surface 17 of the sheet 16. An edge 29 of the bent end 22 supports the edge 19 of the sheet 16. The bent ends 22 may be attached to the sheet 16 by the adhesive layer near the edge 29 to allow the sheet 16 room for insertion between the first section 24 and the body 28. The adhesive may be of a type allowing repeated attachment and removal of a sheet. In an embodiment in which the bent end 22 has no adhesive layer, the sheet 16 is still supported because of the rigidity of the bent end 22.

Figure 5:
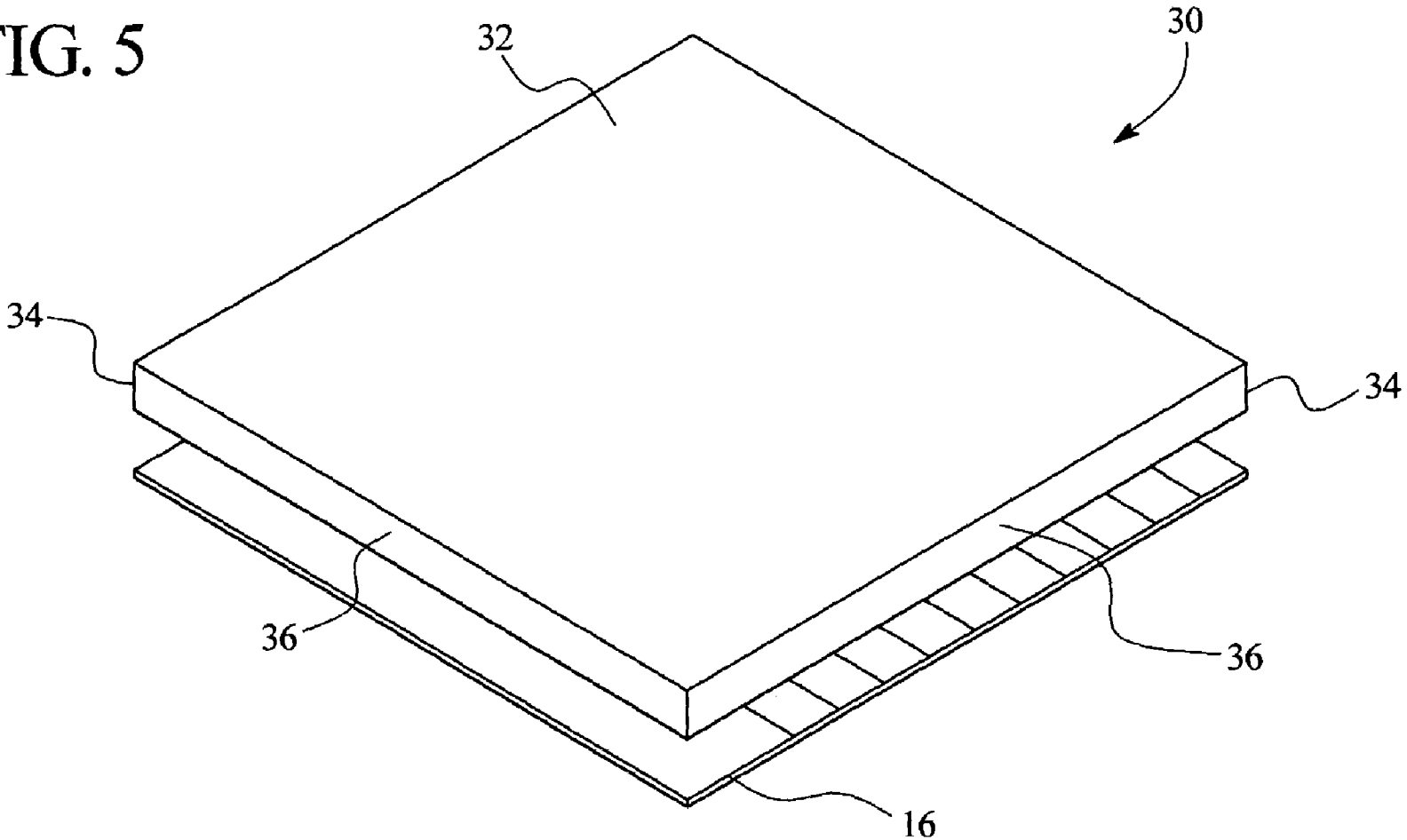
FIG. 5 illustrates a perspective view of a dry erase board in an embodiment of the present invention.

In another embodiment, the dry erase board 30 has a body 32 and a set of bent ends 34 having only a first bent section 36, as illustrated in FIG. 5. The bent ends 34 extend along the periphery of the body 32. The bent ends 34 are preferably perpendicular to the body 32. As a result, the bent ends 34 come in contact with the edges of a sheet 16 that is placed within the dry erase board 30. The bent ends 34 provide a frame that supports the sheet 16 within the dry erase board 30. However, a user may still use tape, glue, or other means to secure the sheet 16 to the dry erase board 30. The open-ended design of the dry erase board 30 allows convenient placement and displacement of multiple sheets having alternate indicia.

In yet another embodiment of the present invention, a dry erase board 40 is provided having two bent ends 42 on opposite ends of the body 44, as seen in FIG. 6. The bent ends 42 are positioned toward the body 44 on the same side of the body 44. This enables a sheet 16 to be inserted between both bent ends 42 and the body 44.

In an embodiment, the body 44 is given chemical or heat treatment such that it may be bent, as illustrated in FIG. 7. In this position, the body 44 provides two distinct sections 46 in which a sheet may be inserted. A user may insert two separate sheets having different indicia in the dry erase board 40. The user may write on the body 44 or the bent end 42 using a dry erase marker, since the body 44 and the bent end 42 have dry erase characteristics. This may prove useful when using items such as flash cards or the like.

In yet another embodiment of the present invention, a dry erase board 50 is provided having a body 52 and a pocket 54. The pocket 54 may be constructed from materials similar to the body 52. The pocket 54 is secured along its edges 56 to the body 52 by an adhesive. In another embodiment, the pocket 54 is integrally formed.

Figure 8:
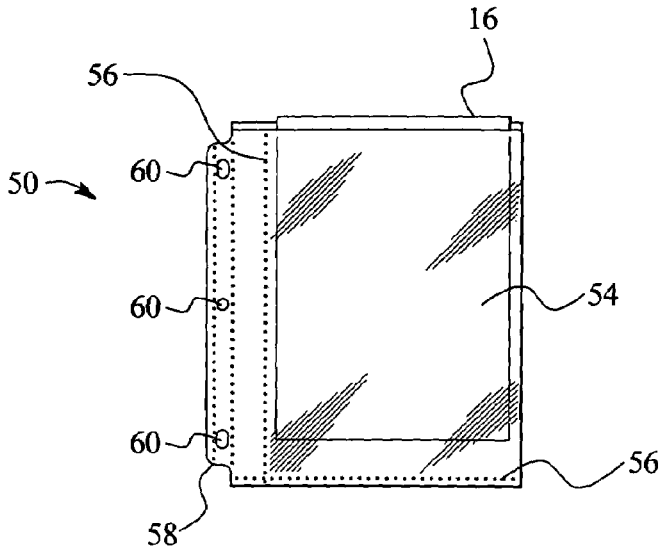
FIG. 8 illustrates a perspective view of a dry erase board in an embodiment of the present invention.
Figure 9:
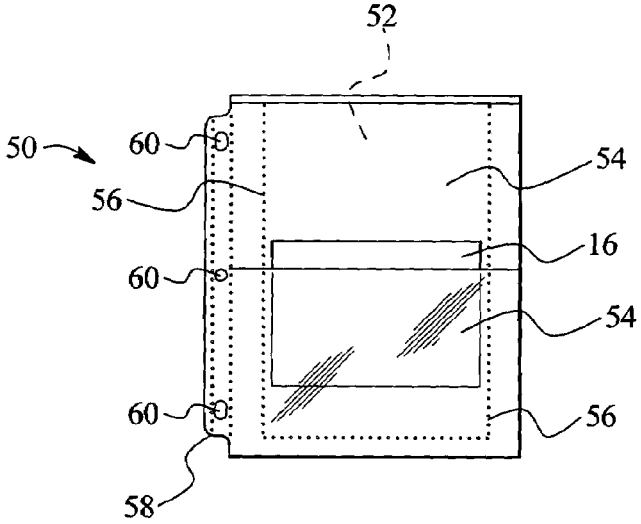
FIG. 9 illustrates a perspective view of a dry erase board in an embodiment of the present invention.
Figure 10:
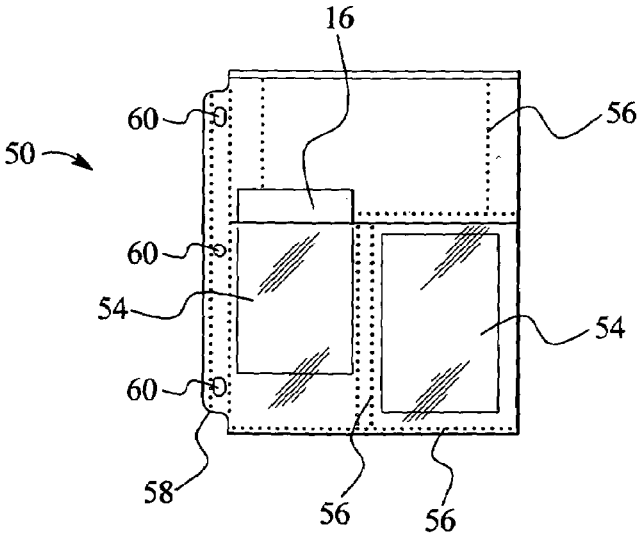
FIG. 10 illustrates a perspective view of a dry erase board in an embodiment of the present invention.

In an embodiment, the pocket 54 is substantially as large as the body 52, as seen in FIG. 8. In another embodiment, the pocket 54 is approximately half the size of the body 52, as seen in FIG. 9. In another embodiment, the pocket 54 is approximately a quarter of the size of the body 52, as seen in FIG. 10. It is appreciated that the size of the pocket 54 is not limited to the examples provided, but may be any size suitable for use with the body 52.

A user inserts a sheet 16 between the pocket 54 and the body 52. A user may then write on the pocket 54 or the body 52 in correlation to the indicia on the sheet 16.

In the illustrated embodiment, the dry erase board 50 has a section 58 having holes 60. The holes 60 enable the dry erase board 50 to be used in a binder, for example. The binder secures the dry erase board 50, providing added convenience for writing on the body 52 or pocket 54.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that all such changes and modifications be covered by the appended claims.

The invention is claimed as follows:

1. A dry erase board comprising:

a semi-rigid body having a dry-erasable surface, the body having at least one bent end that will not revert to a flat state, wherein the bent end is capable of removably securing a portion of a sheet of paper to the body.

2. The dry erase board of claim 1 being in a flat state when shipped to a user.

3. The dry erase board of claim 1, wherein the dry-erasable surface ends across an entire front face of the body.

4. The dry erase board of claim 3, wherein the body has only one bent end.

5. The dry erase board of claim 1, wherein the entire body is transparent.

6. The dry erase board of claim 1, wherein the body has at least one hole along a side.

7. The dry erase board of claim 1, including a plurality of bent ends which extend along a periphery of the body.

8. A method for manufacturing a dry erase board, the method comprising the steps of:

providing a transparent semi-rigid flat body having a dry-erasable surface and no bent ends; and bending at least one side of the body to create at least one area for receiving a sheet that will not revert to a flat state.

9. The method of claim 8, including the step of applying an adhesive to the side.

10. The method of claim 8, wherein the dry erase board is shipped to a user in a flat state prior to the bending of the side.

11. The method of claim 8, including the step of providing a sheet for insertion into the area for receiving the sheet and placing indicia on the sheet.

12. A method of using a dry erase board comprising the steps of:

providing a transparent semi-rigid dry erase board including a front face having a dry-erasable surface and an open back surface for removably receiving a sheet of material;

bending at least one end of the dry erase board to define an area for receiving the sheet of material, in a manner so that the end will not revert to a flat state; and removably securing the sheet of material to the dry erase board.

13. The method of claim 12, comprising the step of bending at least three edges.

14. The method of claim 12, wherein the sheet is removably secured by inserting the sheet in a lip defined by a bent end of the dry erase board.

* * * * *